US010837249B2

(12) United States Patent
Watson et al.

(10) Patent No.: US 10,837,249 B2
(45) Date of Patent: Nov. 17, 2020

(54) DISLODGING TOOLS, SYSTEMS AND METHODS FOR USE WITH A SUBTERRANEAN WELL

(71) Applicant: THRU TUBING SOLUTIONS, INC., Oklahoma City, OK (US)

(72) Inventors: Brock W. Watson, Sadler, TX (US); Roger L. Schultz, Newcastle, OK (US); Gregory A. Kliewer, Edmond, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 0 days.

(21) Appl. No.: 16/232,125

(22) Filed: Dec. 26, 2018

(65) Prior Publication Data

US 2019/0271204 A1 Sep. 5, 2019

Related U.S. Application Data

(60) Provisional application No. 62/638,059, filed on Mar. 2, 2018.

(51) Int. Cl.
*E21B 31/113* (2006.01)
*E21B 31/107* (2006.01)
*E21B 23/04* (2006.01)

(52) U.S. Cl.
CPC ..... *E21B 31/1135* (2013.01); *E21B 31/113* (2013.01); *E21B 23/04* (2013.01); *E21B 31/107* (2013.01); *E21B 2200/06* (2020.05)

(58) Field of Classification Search
CPC ..... E21B 31/1135; E21B 31/113; E21B 2034/007; E21B 23/04; E21B 31/107
See application file for complete search history.

(56) References Cited

U.S. PATENT DOCUMENTS 3,878,889 A 4/1975 Seabourn
5,022,473 A * 6/1991 Taylor ..... E21B 31/107 175/299

(Continued)

OTHER PUBLICATIONS

Wikipedia; "Hyperelastic Material", web page description via https://en.wikipedia.org, dated Feb. 16, 2018, 12 pages.

(Continued)

*Primary Examiner* — David J Bagnell
*Assistant Examiner* — Jonathan Malikasim
(74) *Attorney, Agent, or Firm* — Smith IP Services, P.C.

(57) ABSTRACT

A method of dislodging a tubular string or well equipment connected to the tubular string can include connecting a dislodging tool in the tubular string, so that a flow passage of the dislodging tool extends through the tubular string, deploying a plug into the dislodging tool, applying a pressure differential across the plug, thereby displacing the plug through a seat of the dislodging tool, and dislodging the tubular string or the component in response to the displacing. A dislodging system can include a dislodging tool connected as part of a tubular string, the dislodging tool including a flow passage and a seat configured to sealingly engage a plug deployed into the tubular string, and at least one of a jarring force, load, impact, shock wave, elastic strain release and pressure pulse being generated in the tubular string in response to displacement of the plug through the seat.

31 Claims, 11 Drawing Sheets

(56) References Cited

U.S. PATENT DOCUMENTS

| | | | | |
|---|---|---|---|---|
| 5,146,992 | A * | 9/1992 | Baugh | E21B 23/08 166/154 |
| 5,797,454 | A | 8/1998 | Hipp | |
| 6,050,336 | A * | 4/2000 | Willauer | E21B 23/06 166/117 |
| 6,318,470 | B1 | 11/2001 | Chang et al. | |
| 6,820,697 | B1 * | 11/2004 | Churchill | E21B 21/103 166/374 |
| 9,677,370 | B2 * | 6/2017 | Richards | E21B 33/134 |
| 2009/0194285 | A1 | 8/2009 | Redlinger et al. | |
| 2009/0283322 | A1 | 11/2009 | Dove | |
| 2014/0060854 | A1 | 3/2014 | Baudoin | |
| 2015/0107829 | A1 | 4/2015 | Themig | |
| 2015/0226031 | A1 | 8/2015 | Heckelaar | |
| 2016/0298424 | A1 | 10/2016 | Themig | |
| 2017/0247969 | A1 | 8/2017 | Jones | |
| 2017/0342806 | A1 | 11/2017 | Themig et al. | |
| 2018/0283123 | A1 * | 10/2018 | Baudoin | E21B 31/1135 |
| 2019/0003259 | A1 * | 1/2019 | Grosz | E21B 10/20 |

OTHER PUBLICATIONS

Simscale; "Hyperelastic Materials", SimScale Documentation web page description via www.simscale.com, dated Jan. 3, 2019, 7 pages.

International Search Report with Written Opinion dated Apr. 26, 2019 for PCT Patent Application No. PCT/US2018/067571, 11 pages.

* cited by examiner

DISLODGING TOOLS, SYSTEMS AND METHODS FOR USE WITH A SUBTERRANEAN WELL

BACKGROUND

This disclosure relates generally to equipment utilized and operations performed in conjunction with a subterranean well and, in an example described below, more particularly provides tools, methods and systems for dislodging equipment in a wellbore.

For various reasons, a tubular string or another downhole well component may become stuck in a wellbore. Jarring tools are known in the art, which produce impacts in response to displacement of a tubular string, wireline, slickline or other conveyance connected to the jarring tools. However, in exceptionally deep or long horizontal wellbores, it can be difficult to produce sufficient impacts to dislodge a tubular string or another component using conventional jarring tools.

Therefore, it will be appreciated that improvements are continually needed in the art of dislodging tubular strings and other components or well equipment in subterranean wells. Such improvements may be useful in exceptionally deep or long horizontal wellbores, or the improvements may be useful in other situations.

DETAILED DESCRIPTION

Figure 1:
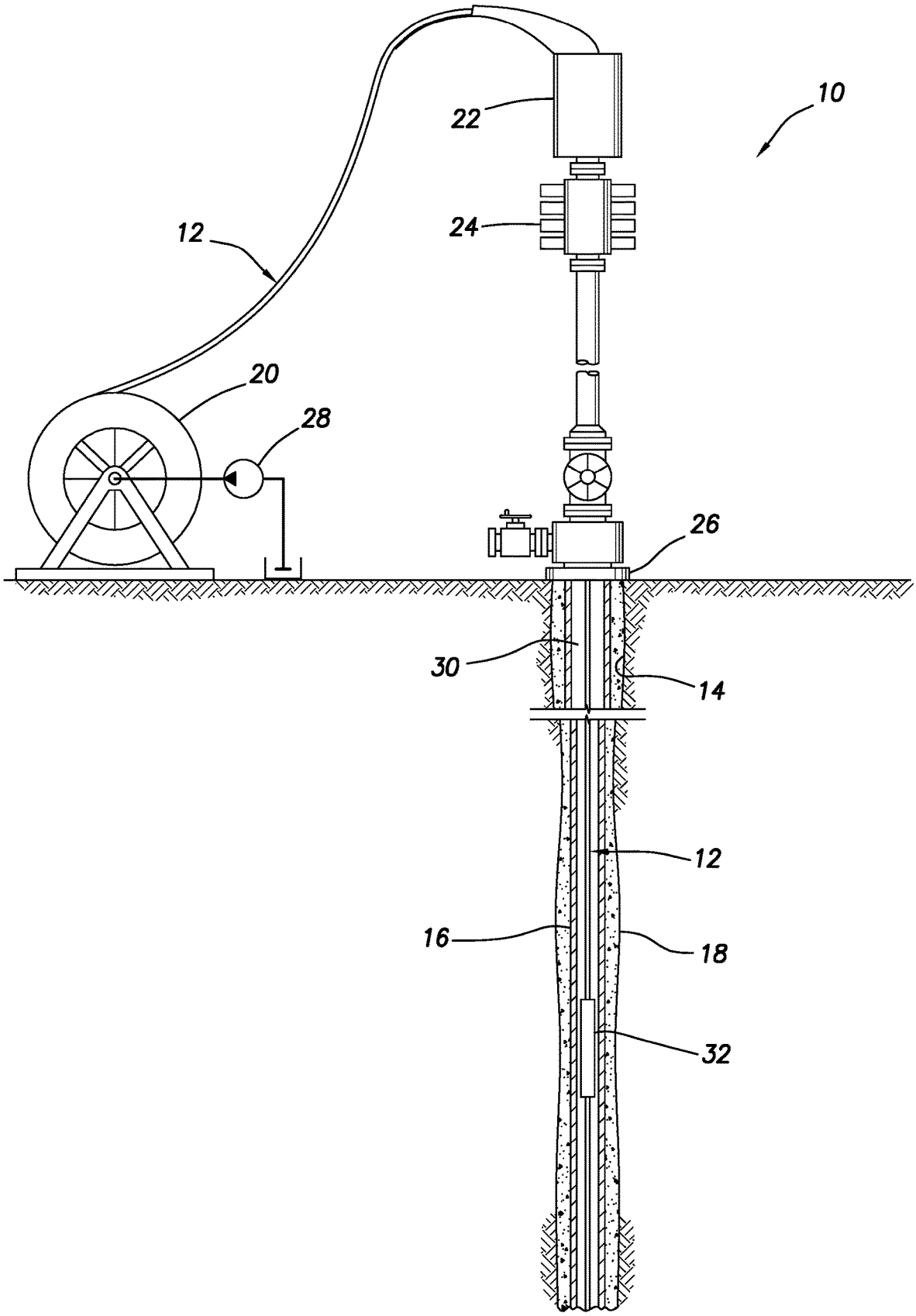
FIG. 1 is a representative partially cross-sectional view of an example of a dislodging system and associated method which can embody principles of this disclosure.

Described herein are examples of a downhole tool, a system and a method for dislodging a tubular, a tool string and/or an object which is stuck in a wellbore. In one example, the tool comprises an internal seat. The tool is connected to a tubular string, an object and/or other well equipment stuck in the wellbore. The seat receives a plug (such as, a ball, dart or other geometry component) pumped or otherwise conveyed to the seat (for example, pumped from surface through coiled tubing, jointed pipe, etc.).

Once the plug is landed on the seat, pressure is applied to the tubular string to build stored energy in both compressed fluid inside the tubular string, and elastic strain in the tubular string. The plug is pumped through the seat when a sufficient pressure differential has been applied across the plug for a sufficient amount of time.

When the plug is ejected from the seat, a resulting release of stored energy creates a jarring load on the tubular string. This jarring load can be sufficient to dislodge the stuck object, tool string, tubular or other well equipment.

In one example, a substantially non-deformable seat is used in conjunction with a hyperelastic plug (a rubber ball, for example) pumped, or otherwise conveyed into sealing engagement with the seat. When a pressure differential is applied across the hyperelastic plug, a rate at which the plug will pass through the seat is both pressure and time dependent.

For example, the plug will pass through the seat after a certain pressure differential is applied across the plug for a certain period of time. If a higher pressure differential is applied, the plug will pass through the seat in a shorter period of time. Conversely, if a lower pressure differential is applied, the plug will pass through the seat in a longer period of time.

A hardness (for example, rubber durometer) of the plug also affects the pressure differential and time required to cause the plug to pass through the seat. Greater plug hardness requires increased pressure differential and/or longer time to force the plug through the seat, and lesser plug hardness requires decreased pressure differential and/or shorter time to force the plug through the seat.

In some examples, a geometry of the seat and downhole temperature also affect the time/pressure differential relationship required to force the plug through the seat. In general, increased seat restriction or friction will result in a greater pressure differential and/or time period needed to force the plug through the seat, and increased temperature will result in a decreased pressure differential and/or time period needed to force the plug through the seat.

In one example method, a hyperelastic plug is pumped from the surface through a tubular string. The tubular string is stuck in a wellbore, or is connected to a tool string or object stuck in the wellbore.

The hyperelastic plug lands on, and sealingly engages, the seat, such that it is possible to increase pressure inside the tubular string above the seat. Pressure is applied to the tubular string and, after a period of time, the hyperelastic plug progresses completely through the seat, thereby releasing the pressure (suddenly decreasing pressure in the tubular string above the seat), and producing a jarring force, which can dislodge the stuck tubular, tool string or component.

The time/pressure differential dependent nature of the progression of the hyperelastic plug through the seat makes it possible to choose a particular pressure differential at which the plug will be released from the seat. Furthermore, the choice can be made at any point, including after the tool has been introduced into a well.

For example, if it is desired for the release pressure differential to be 3000 psi (~20.7 MPa), the plug can be pumped or otherwise conveyed to the seat, the pressure on the tubular string can be increased to apply the 3000 psi pressure differential across the plug, and the pressure differential can be maintained at 3000 psi. After a certain period of time (determined by various factors, including but not limited to, temperature, seat geometry, plug geometry, plug material characteristics (such as, hardness and presence of fillers), etc.), the plug will pass through the seat, thereby releasing the pressure applied to the tubular string.

If the desired release pressure differential is instead 5000 psi (~34.5 MPa), that pressure differential can be applied and maintained across the plug. After a certain period of time (which period of time will generally be less than the period of time if 3000 psi pressure differential had been applied), the plug will pass through the seat, thereby releasing the pressure applied to the tubular string above the plug.

The time dependent nature of this process when using a hyperelastic plug also makes it possible to adjust the release pressure differential to any desired level while the plug is still progressing through the seat, but before the release occurs. This is advantageous in some examples, because it allows the pressure differential to be raised to its maximum, without exceeding a maximum working pressure for the tubular string or any other components.

An example method for dislodging a tubular, tool string or component stuck in a wellbore can include the following steps:

1. Convey a plug to a seat connected in a tubular string in the well.
2. Increase pressure in the tubular string to thereby apply a desired release pressure differential across the plug.
3. Wait a corresponding period of time until the plug passes through the seat, producing a jarring force.
4. Repeat steps 1-3 if desired.

Note that it is not necessary in all examples for the plug to comprise a hyperelastic material. In other examples, the seat could comprise a hyperelastic material. In some examples, both the plug and the seat could comprise the same, or different, hyperelastic material(s). Some representative examples can include:

1. A non-hyperelastic seat used with a hyperelastic ball or other plugging component.
2. A hyperelastic seat used with a non-hyperelastic ball or other plugging component.
3. A hyperelastic seat used with a hyperelastic plugging component.
4. A non-hyperelastic seat used with a non-hyperelastic ball or other plugging component.

Preferably, in examples in which the plug deforms when it passes through the seat, the plug comprises a material that is capable of withstanding substantial strain without incurring permanent damage or significant plastic deformation. A suitable material for this purpose is rubber.

Generally, the time required for the plug to pass through the seat will decrease with increasing pressure differential across the plug. In addition, the seat and/or plug can be designed so that the time it takes for the plug to pass through the seat can increase or decrease as the pressure differential is increased. In some examples, the system can also be designed such that, if the pressure differential is increased, the pass through time will decrease.

In some examples, an expandable seat may be used with a substantially non-deformable plug to produce a pressure build-up in a tubular string, and then a release of pressure, to create a jarring force downhole. In such examples, the seat can be designed to elastically deform, to thereby allow a ball or other plug to pass through the seat when a specific pressure differential is applied.

Different release pressure differential levels can be achieved by passing different sized plugs through the elastic seat (e.g., a greater pressure differential is used to force a larger plug through a given elastic seat, and a lower pressure differential is used to force a smaller plug through the seat). Highly elastic seat materials, such as titanium or beryllium copper, can be used to increase a range of plug sizes (and, thus, a corresponding release differential pressure range) that can be forced through the seat.

Very deformation-resistant materials, such as silicon nitride, can be used for the plug if desired. In such examples, there may be no (or negligible) plastic deformation of the plug.

Representatively illustrated in FIG. 1 is a dislodging system 10 and associated method for use with a subterranean well, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the system 10 as depicted in FIG. 1, a tubular string 12 is deployed into a wellbore 14 lined with casing 16 and cement 18. The wellbore 14 in this example is generally vertical, but in other examples the wellbore could be horizontal, deviated or otherwise inclined relative to vertical. It is not necessary for the wellbore 14 to be cased or cemented in sections of the wellbore where the method is practiced.

The tubular string 12 in this example comprises coiled tubing, but in other examples the tubular string could be made up of separate tubing joints connected together by threaded connections, or other types of connections. The scope of this disclosure is not limited to use of any particular type of tubular string, tubing or other well equipment.

The tubing is "coiled" in that it is stored at surface on a spool or reel 20. An injector 22 and a blowout preventer stack 24 connected to a wellhead 26 may be used to convey the tubular string 12 into and out of the wellbore 14. A pump 28 may be used to apply pressure to an interior flow passage of the tubular string 12.

An annulus 30 is formed radially between the tubular string 12 and the casing 16 in the FIG. 1 example. In some situations, the annulus 30 could become restricted, for example, due to debris accumulation in the annulus, collapse of the casing 16, etc. Such situations and others can cause the tubular string 12 to become stuck, so that it cannot be conveyed through the wellbore 14 to the surface or to another position in the wellbore.

The tubular string 12 in this example includes a dislodging tool 32, which can be operated to produce a jarring force in the tubular string. This jarring force can free the tubular string 12, so that it is no longer stuck in the wellbore 14.

Note that it is not necessary for the tubular string 12 to be the component which is stuck in the wellbore 14. In other examples, the tubular string 12 could be connected to, or in contact with, another component that is stuck in the wellbore 14. A bottom hole assembly could comprise multiple components stuck in the wellbore 14. In these examples, the jarring force can be transmitted from the tubular string 12 to the other component.

Figure 2:
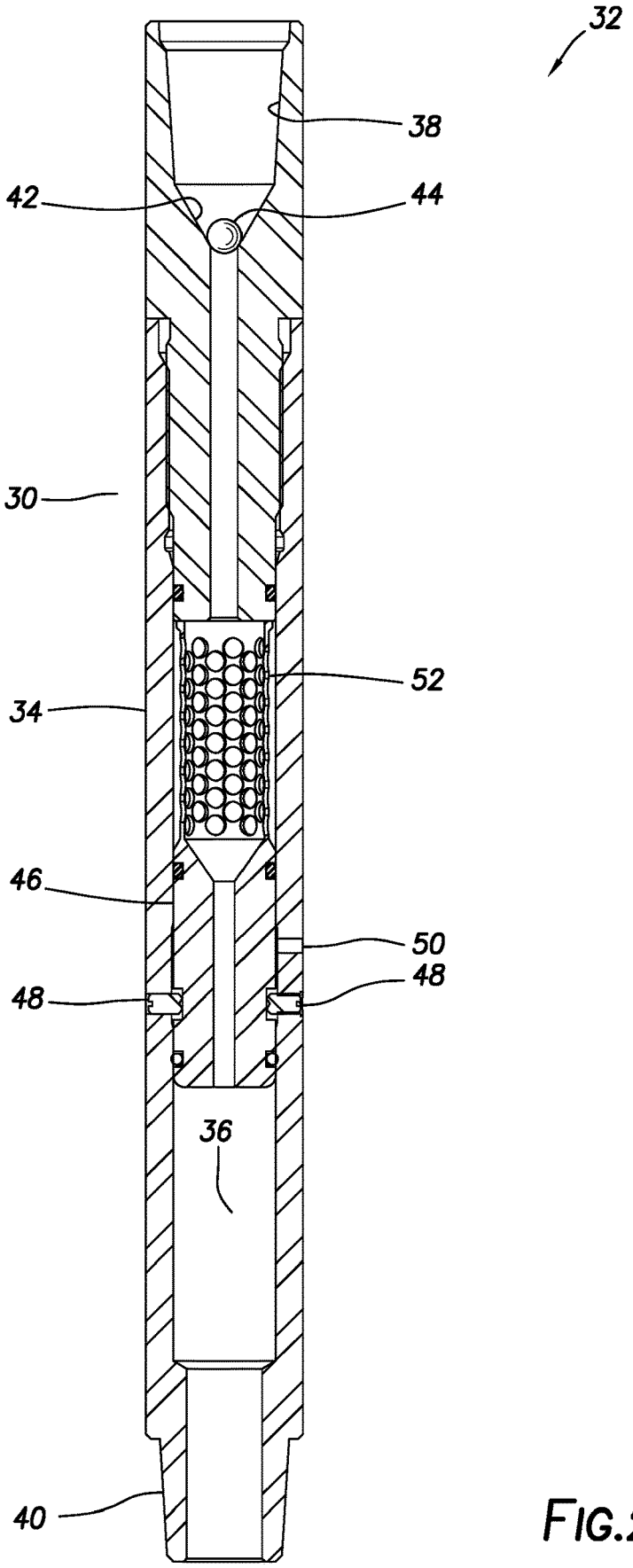
FIG. 2 is a representative cross-sectional view of an example of a dislodging tool that may be used with the FIG. 1 system and method, and which may incorporate the principles of this disclosure.

Referring additionally now to FIG. 2, a cross-sectional view of an example of the dislodging tool 32 is representatively illustrated, apart from the remainder of the FIG. 1 system 10. The dislodging tool 32 may be used with other systems and methods, in keeping with the principles of this disclosure.

The FIG. 2 dislodging tool 32 is generally tubular, in that it includes a tubular outer housing assembly 34 having a central flow passage 36 extending longitudinally through the housing assembly. Upper and lower connectors 38, 40 are used to connect the tool 32 in a tubular string (such as the tubular string 12 in the FIG. 1 system 10).

Below the upper connector 38, a plug seat 42 is configured to sealingly engage a plug 44 introduced into the flow passage 36. In normal operations, in which the jarring force is not required for dislodging the tubular string 12 or another component, the plug 44 would not be introduced into the flow passage 36. The plug 44 is introduced into the flow passage 36 (for example, by dropping or pumping the plug into the tubular string 12 from the surface) when it is desired to produce the jarring force.

A sleeve 46 is releasably retained in the housing assembly 34 below the seat 42 by shear members 48. A perforated plug retainer 52 extends upwardly from the sleeve 46.

The flow passage 36 extends longitudinally through the sleeve 46. In the position of the sleeve 46 depicted in FIG. 2, the sleeve blocks flow through one or more ports 50 formed radially through a sidewall of the housing assembly 34. In some examples, the ports 50 may not be used.

The plug 44 in the FIG. 2 example is spherically-shaped and comprises a hyperelastic material. In other examples, the plug 44 may have shapes other than spherical, and the plug can comprise materials other than hyperelastic materials.

After the plug 44 is deployed into the flow passage 36 and the plug sealingly engages the seat 42, increased pressure can be applied to the flow passage 36 above the plug (for example, using the pump 28). In this manner, a pressure differential across the plug 44 is produced.

Note that, in this example, the phrase "above the plug" refers to the flow passage 36 extending from the plug 44 and through the tubular string 12 to the surface. In other examples (such as, in a highly deviated or horizontal wellbore), portions of the flow passage 36 extending from the plug 44 and through the tubular string 12 to the surface may not be vertically "above" the plug 44.

In the FIG. 2 example, the pressure differential can be any desired pressure differential, limited only by factors such as a pressure rating of the tubular string 12 or other well equipment, a pressure output of the pump 28, etc. In general, the greater the pressure applied to the tubular string 12 above the plug 44, the greater the resulting jarring force produced when the plug is displaced through the seat 42.

As discussed above, the time period required for the plug 44 to be displaced through the seat 42 varies based on a variety of different factors. For example, the time period can be inversely related to the pressure differential across the plug 44, and to the downhole temperature at the tool 32. The time period can be directly related to the hardness of the plug 44 material, other properties or characteristics of the plug material, and to the geometry (e.g., size or shape) of the plug.

However, the scope of this disclosure is not limited to any particular relationship between the time period and any particular factor or factors that may or may not be varied. Factors other than the pressure differential across the plug 44, the downhole temperature, the hardness or other properties of the plug material and the size of the plug may influence the time period required for the plug to be displaced through the seat. Other factors could include, for example, a coefficient of friction between the plug 44 and the seat 42, a tortuosity of the seat, etc.

Figure 3:
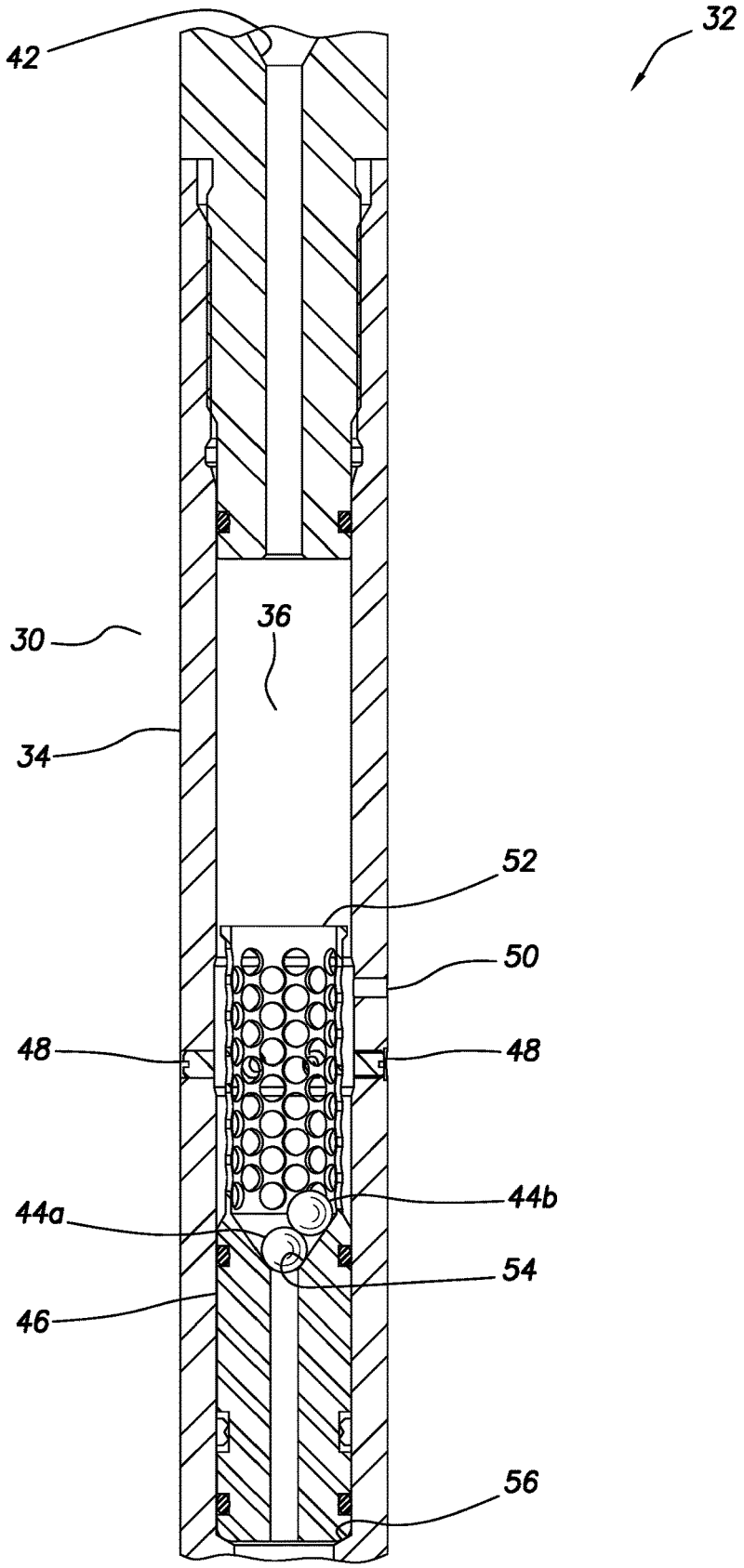
FIG. 3 is a representative cross-sectional view of a section of the dislodging tool in an activated configuration.

Referring additionally now to FIG. 3, the dislodging tool 32 is representatively illustrated after multiple plugs 44*a,b* have been displaced through the seat 42. Note that it is not necessary for multiple plugs to be displaced through the seat 42, but the FIG. 3 example demonstrates that multiple plugs can be displaced through the seat if it is desired to produce multiple jarring forces.

When the first plug 44*a* is sealingly engaged with the seat 42, a pressure differential is applied across the plug to displace the plug through the seat. The plug 44*a* then displaces into the sleeve 46, where it sealingly engages another seat 54. This causes the pressure differential to be applied across the sleeve 46, thereby shearing the shear members 48 and displacing the sleeve 46 downward to its FIG. 3 open position.

In the FIG. 3 open position of the sleeve 46, flow is permitted through the port 50. Thus, the increased pressure previously applied to the flow passage 36 is vented to the exterior of the tool 32 (e.g., to the annulus 30).

This suddenly decreases the pressure in the tubular string 12 above the tool 32, relieves strain in the tubular string 12 above the tool, and transmits fluid pressure pulses through the tubular string. The sleeve 46 can also impact an internal shoulder 56 in the housing assembly 34, thereby transmitting a shock wave through the tubular string 12.

These resulting forces, impacts, pressure pulses, shock waves, etc., can function to dislodge the tubular string 12 or another component, so that it is no longer stuck in the wellbore 14. Note that it is not necessary for all of these to result from the operation of the tool 32. The scope of this disclosure is not limited to any particular combination of forces, impacts, pulses, shock waves, etc., produced by operation of the tool 32.

In some examples, fluid communication may not be permitted between the interior and exterior of the tool 32 in response to displacement of the sleeve 46. As mentioned above, it is not necessary for the ports 50 to be provided in the housing assembly 34. The plug retainer 52 may still be used, in such examples, to prevent the plug(s) 44*a,b* from passing into the flow passage 36 below the tool 32.

If the tubular string 12 or other component is not dislodged as a result of the first plug 44*a* being displaced through the seat 42, the second plug 44*b* can be deployed into the flow passage 36 to sealingly engage the seat 42. The same or a different pressure differential may then be applied across the second plug 44*b* to force it to displace through the seat 42. For example, the pressure differential applied across the second plug 44*b* could be greater than the pressure differential previously applied across the first plug 44*a*, in order to produce a greater pressure pulse and release of strain energy in the tubular string 12.

Any number of plugs may be displaced through the seat 42. It is not necessary for the plugs 44*a,b* to be configured the same. For example, the plugs 44*a,b* could have different sizes, could be made of different materials, could have different hardnesses or other properties, different configurations, etc.

Figure 4:
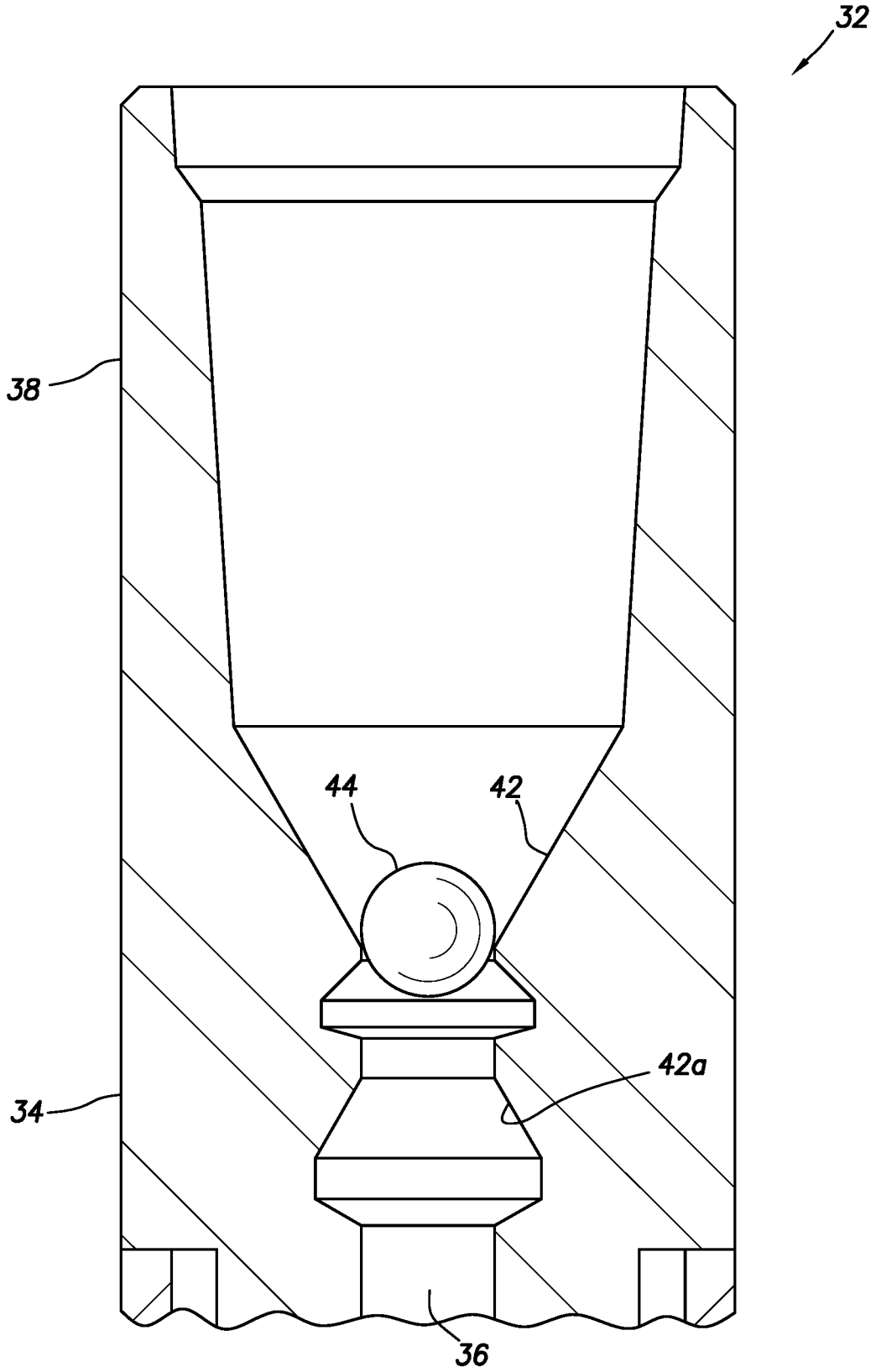
FIG. 4 is a representative cross-sectional view of a section of another example of the dislodging tool.

Referring additionally now to FIG. 4, a section of another example of the dislodging tool 32 is representatively illustrated. In this example, the seat 42 has a tortuous inner plug engagement profile 42*a* that engages the plug 44 as it displaces through the seat.

This varying engagement between the plug 44 and the seat profile 42*a* can be used to vary the pressure differential and/or time required to displace the plug through the seat 42, and can be used to produce variations in the forces, pulses, etc., produced when the plug displaces through the seat. A rate of displacement of the plug 44 through the seat 42 can increase as an inner dimension (such as, an inner diameter) of the seat 42 increases (thereby reducing contact pressure and friction between the plug and the seat), and the rate of displacement can decrease as the inner dimension decreases (thereby increasing contact pressure and friction).

The variations in the forces, pulses, etc., produced when the plug 44 displaces through the seat 42 can be advantageous for dislodging the tubular string 12 or other component in the wellbore 14. In some examples, the variations in the forces, pulses, etc., can produce corresponding beneficial vibrations in the tubular string 12 or other component to be dislodged.

Figure 5:
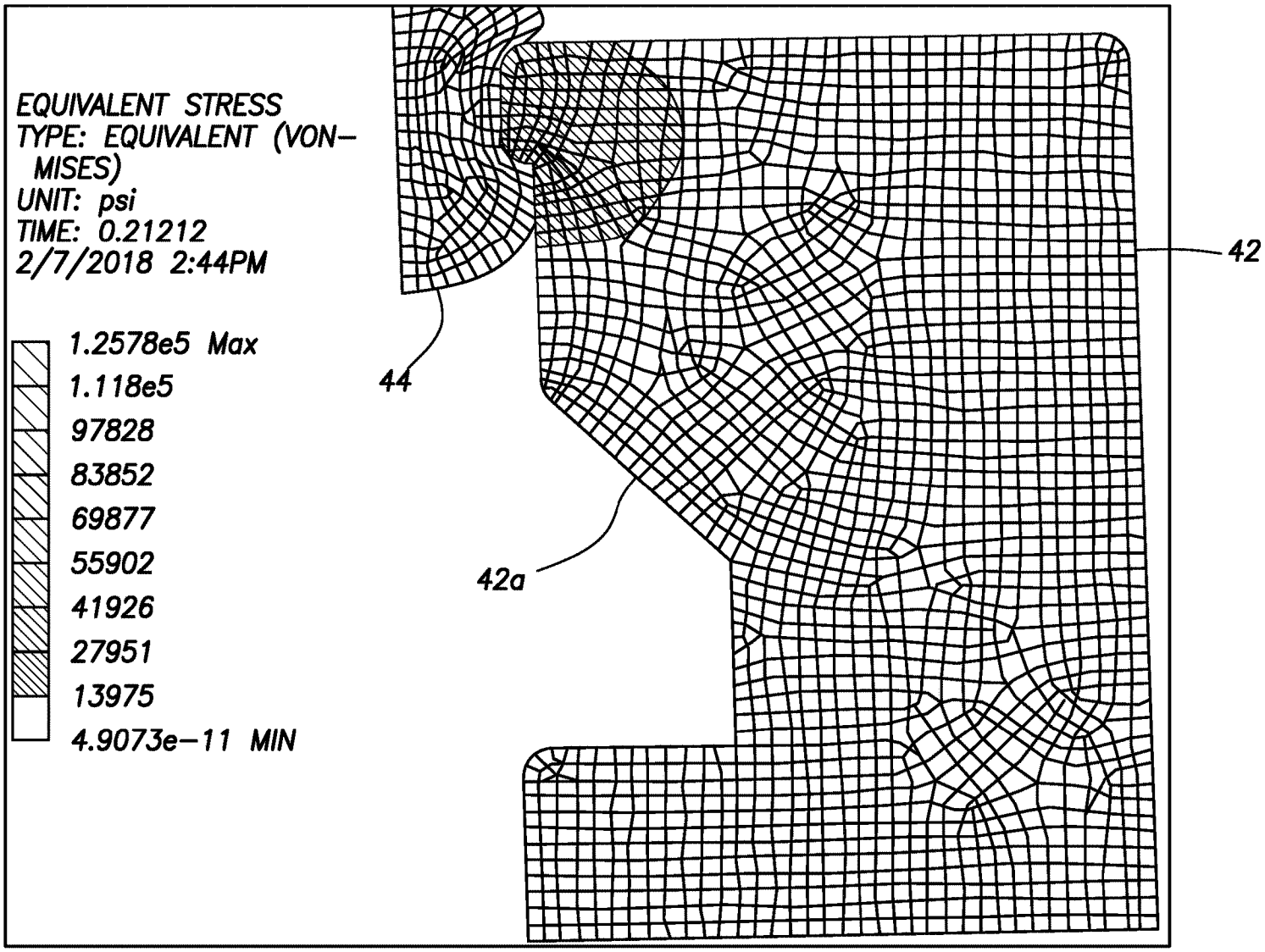
FIG. 5 is a representative example of a diagram of stress in a seat of the dislodging tool.

In FIG. 5, an example model of the plug 44 and a seat 42 can be seen to produce certain levels of stress in the plug and seat in response to the pressure differential applied across the plug. FIG. 5 depicts equivalent (von Mises) stress in units of psi (pounds per square inch).

Figure 6:
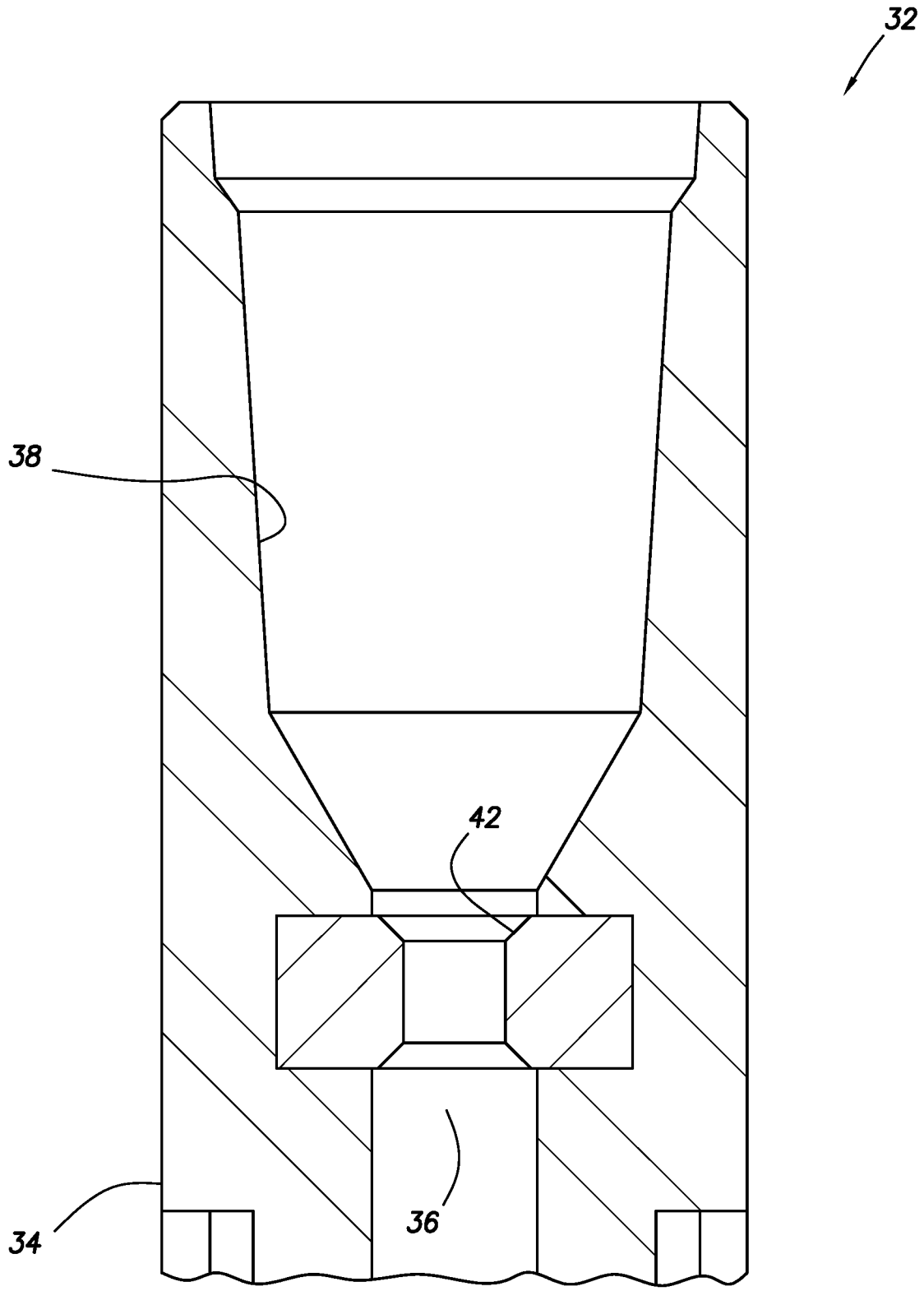
FIG. 6 is a representative cross-sectional view of a section of another example of the dislodging tool.

Referring additionally now to FIG. 6, another example of the dislodging tool 32 is representatively illustrated. In this example, the seat 42 is expandable to permit the plug 44 (see FIGS. 2-5) to displace through the seat when the plug is engaged with the seat and a pressure differential is applied across the plug over a sufficient time period.

The seat 42 could comprise a hyperelastic material. The plug 44 could comprise a hyperelastic material or a substantially non-deformable material. In some examples, the seat 42 could comprise a non-hyperelastic material that is elastically deformable.

Similar to the discussion above regarding variations in the pressure differential and time required to displace the plug 44 through the seat 42, in the FIG. 6 example the pressure differential may be varied and the time may be varied in response to a variety of different factors. These factors may include a size (such as, internal diameter or other dimension) of the seat 42, a material of the seat, the material hardness or other characteristic, a geometry or shape of the seat, a coefficient of friction in the seat, temperature, etc.

Figure 7:
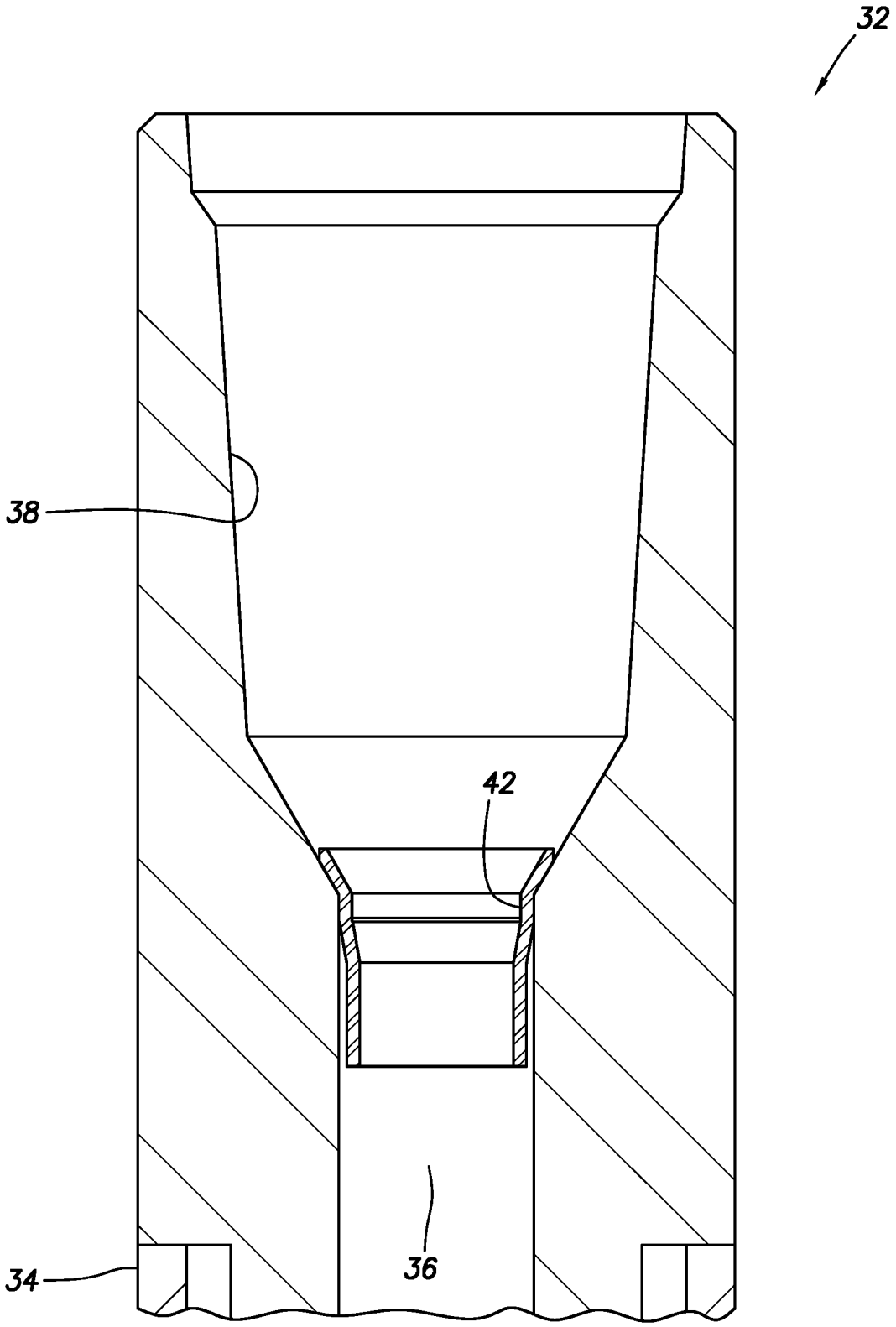
FIG. 7 is a representative cross-sectional view of a section of another example of the dislodging tool.

Referring additionally now to FIG. 7, another example of the dislodging tool 32 is representatively illustrated. In this example, the seat 42 is somewhat similar to the FIG. 6 seat example. In the FIG. 7 example, the seat 42 is expandable to permit the plug 44 (see FIGS. 2-5) to displace through the seat when a pressure differential is applied across the plug for a sufficient period of time.

In this example, the seat 42 could comprise a hyperelastic material. The plug 44 could comprise a hyperelastic material or a substantially non-deformable material. In some examples, the seat 42 could comprise a non-hyperelastic material that is elastically deformable.

Similar to the discussions above regarding variations in the pressure differential and time required to displace the plug 44 through the seat 42, in the FIG. 7 example the pressure differential may be varied and the time may be varied in response to a variety of different factors. These factors may include a size (such as, internal diameter or other dimension) of the seat 42, a material of the seat, the material hardness or other characteristic, a geometry or shape of the seat, a coefficient of friction in the seat, temperature, etc.

Figure 8:
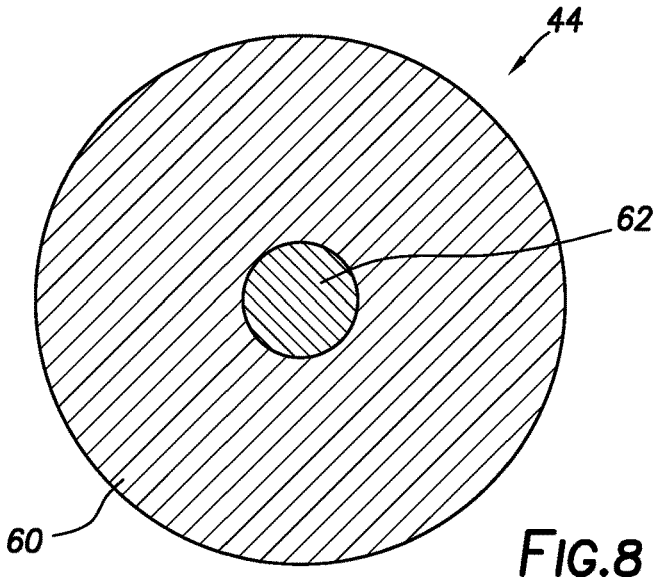
FIG. 8 is a representative cross-sectional view of an example of a plug that may be used in the dislodging tool.

Referring additionally now to FIG. 8, a cross-sectional view of one example of the plug 44 is representatively illustrated. In this example, the plug 44 is made up of multiple materials—an outer material 60, and an inner or core material 62. The FIG. 8 plug 44 may be used with any of the dislodging tool 32 examples described herein.

The outer material 60 can be selected for its capability to be consistently deformed or extruded and displaced through an appropriately configured seat 42. The material 60 can comprise a hyperelastic material, a non-hyperelastic material, an elastic material, a plastically deformable material, or other types of materials that can be displaced through a seat at a known combination of pressure differential, time, temperature, size, configuration, etc.

The inner material 62 can be selected for its capability to change one or more of its characteristics in response to initiating displacement of the plug 44 through the seat 42. For example, the inner material 62 could produce heat (e.g., by conversion of chemical to heat energy) in response to deformation. In this example, the produced heat could increase a temperature of the outer material 60, thereby enabling the plug 44 to displace through the seat 42 at a reduced differential pressure, or in a decreased amount of time.

In another example, the inner material 62 could harden, or have an increased hardness, in response to deformation. In this example, the increased hardness of the inner material 62 could increase the differential pressure or the amount of time required to displace the plug 44 through the seat 42.

In some examples, the inner material 62 could comprise a liquid substance. In further examples, the inner material 62 could comprise a void filled with air or an inert gas, which may or may not be pressurized to greater than atmospheric pressure. The liquid substance, air, inert gas or other substance may be selected to modify characteristics of the plug 44, for example, to enable the plug to consistently extrude through the seat 42 at a known combination of pressure differential, time, temperature, etc.

A variety of different plugs 44 with respective different inner materials 62 could be available to an operator at the surface so that, if it becomes desirable to operate the dislodging tool 32 after it is positioned downhole, the operator can select an appropriate one of the plugs to deploy into the tubular string 12 (e.g., a plug 44 that will displace through the seat 42 at a given pressure differential in an acceptable amount of time to produce a desired jarring force, pressure pulse, impact, etc.). A succession of differently configured plugs 44 could be deployed, so that a corresponding set of different jarring forces, pressure pulses, impacts, etc., are generated in response to respective different differential pressures used to displace the plugs through the seat 42.

Figure 9A:
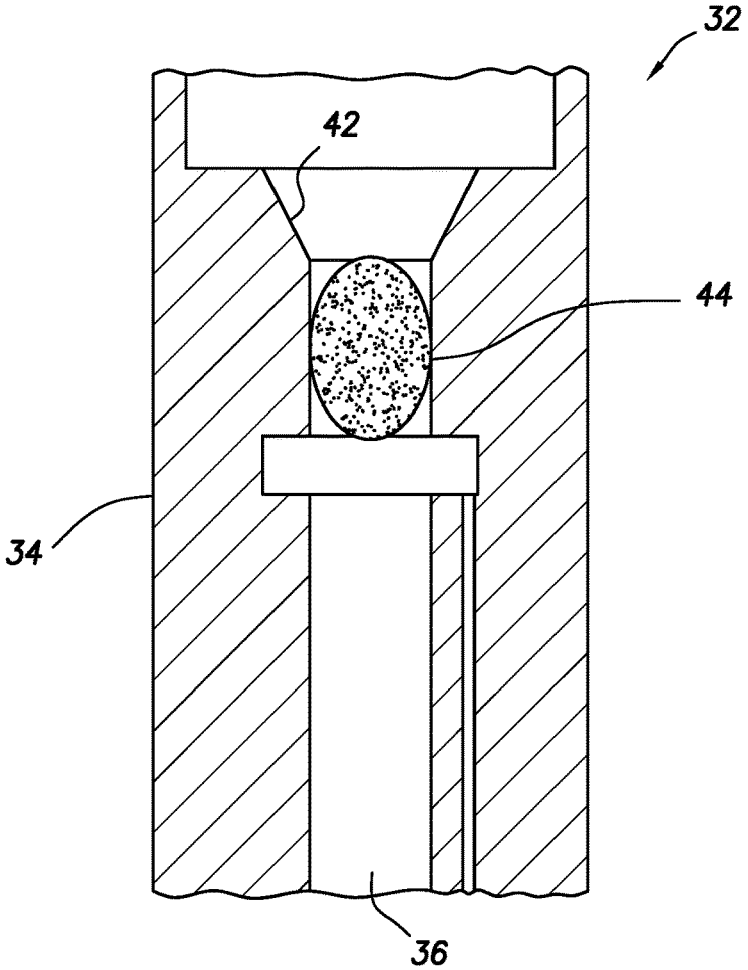
FIGS. 9A-C are representative cross-sectional views of another example of the dislodging tool in successive stages of displacement of the plug through the seat.
Figure 9B:
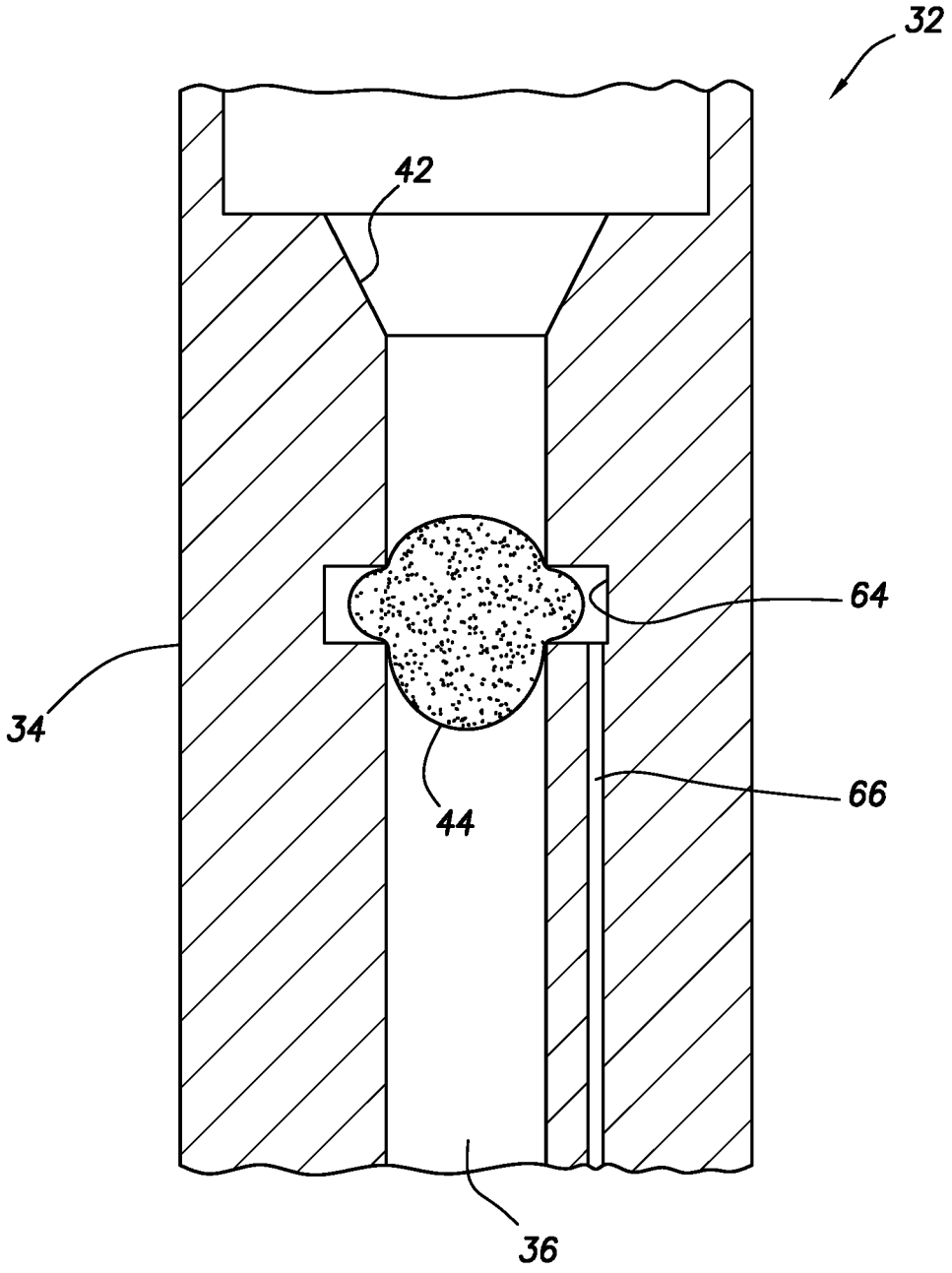
Figure 9C:
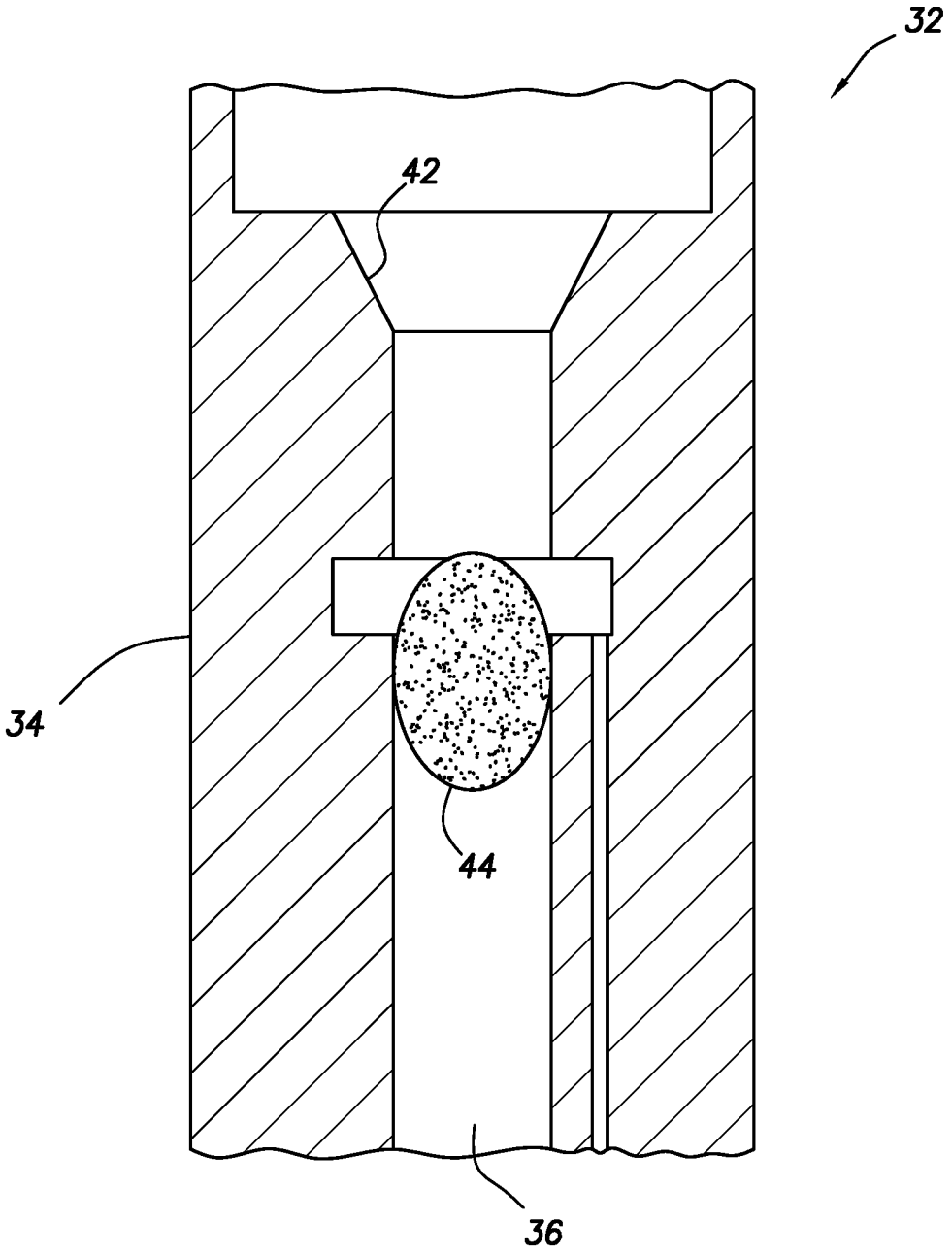

Referring now to FIGS. 9A-C, cross-sectional views of another example of the dislodging tool 32 are representatively illustrated. FIGS. 9A-C depict a succession of stages in displacement of the plug 44 through the seat 42 in response to a pressure differential applied across the plug.

In FIG. 9A, the plug 44 has been displaced partially through the seat 42 by the differential pressure. In this stage, a given differential pressure displaces the plug 44 through the seat 42 at a first rate.

In FIG. 9B, the plug 44 has engaged a radially enlarged profile or groove 64, thereby increasing friction between the plug and the seat 42, and causing the plug to displace at a slower second rate through the seat 42. As depicted in FIG. 9B, the plug 44 has extruded outward somewhat into the groove 64.

In this example, the plug 44 engages the groove 64 to increase the friction between the plug and the seat 42. A flow path 66 provides communication between the groove 64 and the passage 36 below the plug so that, when the plug engages the groove, the plug is biased outward with increased contact pressure against the seat, thereby increasing the friction. Thus, the plug 44 displaces at the reduced second rate through the groove 64.

In FIG. 9C, the plug 44 displaces past the groove 64, thereby decreasing the friction between the plug and the seat 42. The friction may return to a level corresponding to that in FIG. 9A, so that the plug 44 displaces again at the first rate, or the plug may displace at a different, third rate (which may be greater than, or less than, the first rate).

In the FIGS. 9A-C example, the rate of displacement changes due to changes in geometry along the seat 42. In other examples, the rate of displacement could change due to other characteristics. An increased differential pressure across the plug 44 can in some examples result in a decreased rate of displacement.

Figure 10:
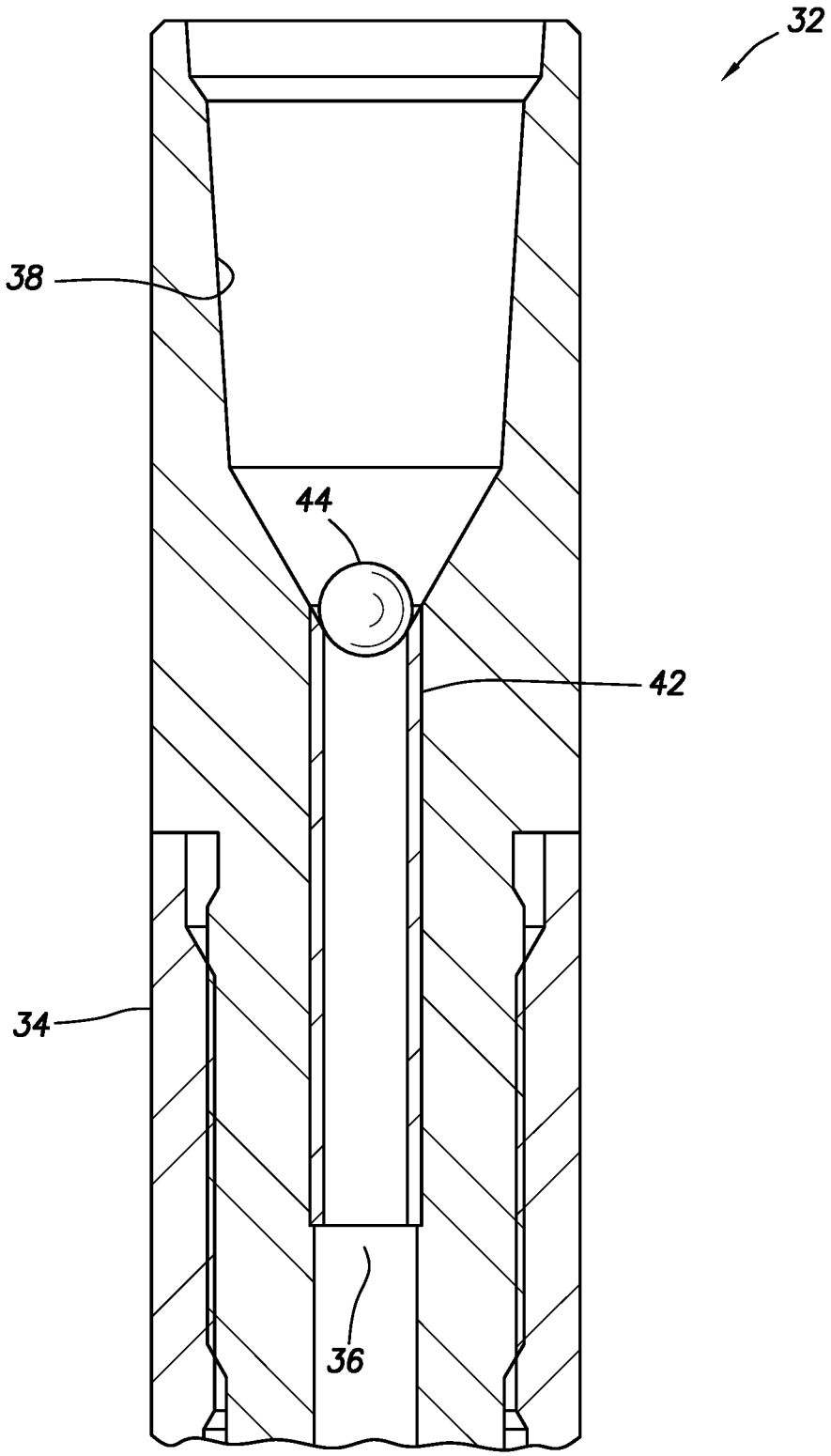
FIG. 10 is a representative cross-sectional view of a section of another example of the dislodging tool.

Referring additionally now to FIG. 10, another example of the dislodging tool 32 is representatively illustrated. In the FIG. 10 example, the seat 42 is in the form of a sleeve received in the outer housing assembly 34.

The seat 42 comprises a material selected to have a desired coefficient of friction in contact with the plug 44 as the plug displaces through the seal. The coefficient of friction is selected, so that the plug 44 displaces through the seat 42 in a desired amount of time with a desired pressure differential across the plug at an expected downhole temperature.

The pressure differential may be varied and the time may be varied in response to a variety of different factors. These factors may include a size (such as, internal diameter or other dimension) of the seat 42 and plug 44, respective materials of the seat and plug, the material hardness or other characteristic of the plug, a geometry or shape of the seat, a length of the seat, a coefficient of friction in the seat, temperature, etc.

As compared to the FIG. 6 example, it may take longer for the plug 44 to pass through the seat 42 in the FIG. 10 example. The seat 42 can be lengthened, if desired, in order to increase the amount of time it takes for the plug 44 to displace through the seat at a given pressure differential. Conversely, the seat 42 can be shortened, if desired, in order to decrease the amount of time it takes for the plug 44 to displace through the seat at a given pressure differential.

It may now be fully appreciated that the above disclosure provides significant advancements to the art of dislodging stuck tubular strings or other structures downhole. In all of the FIGS. 1-10 examples described above, the seat 42 and/or plug 44 (including plugs 44*a*, 44*b*) may comprise a hyperelastic material. Hyperelastic materials can undergo very large strains without permanent deformation, and have a non-linearly elastic stress-strain relationship.

Elastic strain differs from plastic strain in that it is not permanent. In other words, once the load causing the deformation in a material is removed, the material will return to its original shape.

The seat 42 and/or plug 44 material may undergo "creep" as a result of sustained loading. Creep is a change in molecular arrangement in a material that occurs in a time dependent manner. The deformation can be either permanent or temporary depending on the material. Creep can occur at stress levels in a material that are below a stress level which causes plastic deformation due to mechanical overload (e.g., exceeding a yield strength of the material).

In metals, for example, there can be creep that permanently changes a shape of a component comprising the metal over time, without the metal plastically deforming due to mechanical overload. In some materials (such as rubber), there can be creep over time during a loading event that causes large deformation in a component comprising the material, but the component may fully recover its original shape when the load is removed.

The seat 42 and/or plug 44 material may have viscoelastic properties in some examples. Viscoelastic materials exhibit a strain rate dependence on time. Unlike purely elastic deformation, a viscoelastic deformation has an elastic component and a viscous component. The viscosity of a viscoelastic material gives the material a strain rate dependence on time.

Purely elastic materials do not dissipate energy (heat) when a load is applied, then removed. However, a viscoelastic material loses (dissipates) energy when a load is applied, then removed.

Hysteresis is observed in the stress-strain curve for a viscoelastic material, with an area enclosed by the stress-strain curve being equal to the energy lost during a loading cycle. Since viscosity can be considered as a resistance to thermally activated plastic deformation, a viscous material will lose energy through a loading cycle. Plastic deformation results in lost energy, which is uncharacteristic of a purely elastic material's reaction to a loading cycle.

Viscoelastic deformation results in a molecular rearrangement in the material. When a stress is applied to a viscoelastic material, such as a polymer, parts of long polymer chains of the polymer change positions. This movement or rearrangement results in creep.

Polymer materials may remain solid, even when the parts of their chains are rearranging in order to accommodate the stress and, as this occurs, it creates a "back stress" in the material. When the back stress is a same magnitude as the applied stress, the material no longer creeps. When the original stress is taken away, the accumulated back stresses will cause the polymer to return to its original form. Thus, the viscoelastic material creeps, but then fully recovers.

In various examples, the seat 42, plug 44 (or both components) may use the specific material properties of creep, hyperelasticity, viscoelasticity or an appropriate combination of these properties to achieve a pressure release event (e.g., resulting from displacement of the plug through the seat), which is time dependent, pressure dependent, temperature dependent, or any combination of these dependencies, to achieve a desired jarring, impact, pressure pulse, load, elastic strain release and/or shock wave event downhole.

The above disclosure provides to the art a method of dislodging a tubular string 12 or well equipment connected to the tubular string 12 in a subterranean well. In one example, the method comprises: connecting a dislodging tool 32 in the tubular string 12, so that a flow passage 36 of the dislodging tool 32 extends through the tubular string 12; deploying a plug 44 into the dislodging tool 32; applying a pressure differential across the plug 44 in the dislodging tool 32, thereby displacing the plug 44 through a seat 42 of the dislodging tool 32; and dislodging the tubular string 12 or the component in response to the displacing.

In any of the examples described herein, the displacing may comprise deforming the plug 44. In any of the examples described herein, the displacing may comprise deforming the seat 42. In any of the examples described herein, the displacing may comprise deforming the plug 44 and deforming the seat 42.

In any of the examples described herein, the plug 44 and/or the seat 42 may comprise a hyperelastic material. In any of the examples described herein, the plug 44 and/or the seat 42 may comprise a viscoelastic material.

In any of the examples described herein, the method may include, after the displacing step, permitting fluid communication between the flow passage 36 and an exterior of the dislodging tool 32.

In any of the examples described herein, the method may include generating a pressure pulse in the tubular string 12 in response to the fluid communication permitting step.

In any of the examples described herein, the method may include varying the pressure differential during the displacing.

In any of the examples described herein, the displacing step may produce at least one of a jarring force, a load, an impact, a shock wave, an elastic strain release and a pressure pulse.

In any of the examples described herein, the method may include repeating the plug deploying and pressure differential applying steps. Multiple plugs 44 may be displaced through the seat 42.

In any of the examples described herein, the plug 44 displacing may include displacing the plug through a tortuous plug engagement profile 42*a* of the seat 42.

In any of the examples described herein, the plug 44 may include outer and inner materials 60, 62. In any of the examples described herein, the outer material 60 may include at least one of a hyperelastic material, a non-hyperelastic material, an elastic material and a plastically deformable material. In any of the examples described herein, the inner material 62 may include a liquid and/or a gas. In any of the examples described herein, the inner material 62 may produce heat or harden in response to deformation of the inner material 62.

In any of the examples described herein, the seat 42 and/or the plug 44 may not deform during the displacing step.

In any of the examples described herein, a rate of displacement of the plug 44 through the seat 42 may vary as the plug 44 displaces through the seat 42.

In any of the examples described herein, the seat 42 may elastically deform during the displacing step.

A dislodging system 10 for use with a subterranean well is also provided to the art by the above disclosure. In one example, the dislodging system 10 can include a dislodging tool 32 connected as part of a tubular string 12 in the well, the dislodging tool 32 comprising a flow passage 36 and a seat 42 configured to sealingly engage a plug 44 deployed into the tubular string 12, and at least one of a jarring force, a load, an impact, a shock wave, an elastic strain release and a pressure pulse being generated in the tubular string 12 in response to displacement of the plug 44 through the seat 42.

In any of the examples described herein, the plug 44 may displace through the seat 42 in response to a pressure differential applied across the plug 44.

In any of the examples described herein, the plug 44 may deform in response to a pressure differential applied across the plug 44. In any of the examples described herein, the seat 42 may deform in response to a pressure differential applied across the plug 44. In any of the examples described herein, the plug 44 and the seat 42 may deform in response to a pressure differential applied across the plug 44.

In any of the examples described herein, the plug 44 and/or the seat 42 may comprise a hyperelastic material. In any of the examples described herein, the plug 44 and/or the seat 42 may comprise a viscoelastic material.

In any of the examples described herein, fluid communication may be permitted between the flow passage 36 and an exterior of the dislodging tool 32 in response to a pressure differential applied across the plug 44. In any of the examples described herein, a pressure pulse may be generated in the tubular string 12 in response to the fluid communication being permitted between the flow passage 36 and the exterior of the dislodging tool 32.

In any of the examples described herein, a pressure differential across the plug 44 may be varied as the plug 44 displaces through the seat 42. In any of the examples described herein, the seat 42 may comprise a tortuous plug engagement profile 42*a*.

In any of the examples described herein, a rate of displacement of the plug 44 through the seat 42 may vary or change as the plug 44 displaces through the seat 42.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of dislodging a tubular string or well equipment connected to the tubular string in a subterranean well, the method comprising:

connecting a dislodging tool in the tubular string, so that a flow passage of the dislodging tool extends through the tubular string;

deploying a first plug into the dislodging tool;

applying a first pressure differential across the first plug in the dislodging tool, thereby displacing the first plug through a seat of the dislodging tool and transmitting a jarring force to the tubular string;

permitting fluid communication between the flow passage and an exterior of the dislodging tool via a port in a sidewall of the dislodging tool; and dislodging the tubular string or the well equipment in response to the transmitting; and generating a pressure pulse in the tubular string in response to the fluid communication permitting.

2. The method of claim 1, in which the displacing comprises deforming the first plug.

3. The method of claim 1, in which the displacing comprises deforming the seat.

4. The method of claim 1, in which at least one of the group consisting of the first plug and the seat comprises a hyperelastic material.

5. The method of claim 1, in which at least one of the group consisting of the first plug and the seat comprises a viscoelastic material.

6. The method of claim 1, in which the permitting fluid communication comprises displacing a sleeve inside the dislodging tool, thereby opening the port.

7. The method of claim 6, further comprising transmitting a shock wave through the tubular string in response to the displacing the sleeve.

8. The method of claim 1, further comprising varying the first pressure differential during the displacing.

9. The method of claim 1, further comprising deploying a second plug into the dislodging tool; and applying a second pressure differential across the second plug in the dislodging tool, thereby displacing the second plug through the seat of the dislodging tool.

10. The method of claim 1, in which the first plug comprises outer and inner materials.

11. The method of claim 10, in which the outer material comprises at least one of the group consisting of a hyperelastic material, a non-hyperelastic material, an elastic material and a plastically deformable material.

12. The method of claim 10, in which the inner material comprises at least one of the group consisting of a liquid and a gas.

13. The method of claim 10, in which the inner material produces heat or hardens in response to deformation of the inner material.

14. The method of claim 1, in which at least one of the group consisting of the seat and the first plug does not deform during the displacing.

15. The method of claim 1, in which a rate of displacement of the first plug through the seat varies as the first plug displaces through the seat.

16. The method of claim 1, in which the seat elastically deforms during the displacing.

17. The method of claim 1, in which the seat comprises a tortuous inner plug engagement profile which produces variations in the jarring force as the first plug displaces through the seat.

18. A dislodging system for use with a subterranean well, the dislodging system comprising:

a dislodging tool connected as part of a tubular string in the well, the dislodging tool comprising a flow passage and a seat configured to sealingly engage a plug deployed into the tubular string, in which a pressure differential applied across the plug causes the plug to displace through the seat and transmit a jarring force to the tubular string, and in which fluid communication is permitted between the flow passage and an exterior of the dislodging tool via a port in a sidewall of the dislodging tool in response to the pressure differential applied across the plug; and in which a pressure pulse is generated in the tubular string in response to the fluid communication being permitted between the flow passage and the exterior of the dislodging tool.

19. The dislodging system of claim 18, in which the plug deforms in response to the pressure differential applied across the plug.

20. The dislodging system of claim 18, in which the seat deforms in response to the pressure differential applied across the plug.

21. The dislodging system of claim 18, in which at least one of the group consisting of the plug and the seat comprises a hyperelastic material.

22. The dislodging system of claim 18, in which at least one of the group consisting of the plug and the seat comprises a viscoelastic material.

23. The dislodging system of claim 18, in which the pressure differential applied across the plug displaces a sleeve inside the dislodging tool, thereby opening the port.

24. The dislodging system of claim 23, in which a shock wave is transmitted through the tubular string in response to displacement of the sleeve.

25. The dislodging system of claim 18, in which the pressure differential across the plug is varied as the plug displaces through the seat.

26. The dislodging system of claim 18, in which the plug comprises outer and inner materials.

27. The dislodging system of claim 26, in which the outer material comprises at least one of the group consisting of a hyperelastic material, a non-hyperelastic material, an elastic material and a plastically deformable material.

28. The dislodging system of claim 26, in which the inner material comprises at least one of the group consisting of a liquid and a gas.

29. The dislodging system of claim 26, in which the inner material produces heat or hardens in response to deformation of the inner material.

30. The dislodging system of claim 18, in which a rate of displacement of the plug through the seat varies as the plug displaces through the seat.

31. The dislodging system of claim 18, in which the seat comprises a tortuous inner plug engagement profile which produces variations in the jarring force as the plug displaces through the seat.

* * * * *